United States Patent [19]

Flannery

[11] 4,006,567

[45] Feb. 8, 1977

[54] MOVABLE CEILING DEVICE

[75] Inventor: Joe W. Flannery, Toronto, Ontario, Canada

[73] Assignee: The Raymond Lee Organization, Inc., New York, N.Y. ; a part interest

[22] Filed: Oct. 14, 1975

[21] Appl. No.: 621,815

[52] U.S. Cl. ..... 52/126; 52/29; 52/39; 52/64; 52/484; 52/745

[51] Int. Cl.[2] ..... E04B 5/52

[58] Field of Search ..... 52/126, 122, 745, 484, 52/236, 39, 6, 7, 29, 64, 72, 121, 111; 212/23, 24; 254/143, 145

[56] References Cited

UNITED STATES PATENTS

| | | | |
|---|---|---|---|
| 2,484,678 | 10/1949 | Blumer | 52/29 X |
| 2,604,060 | 7/1952 | Hansen | 52/745 X |
| 3,252,688 | 5/1966 | Wiggins | 52/745 X |
| 3,404,494 | 10/1968 | Wolfe | 52/126 X |
| 3,863,418 | 2/1975 | Faucheux | 52/126 X |

FOREIGN PATENTS OR APPLICATIONS

| | | | |
|---|---|---|---|
| 646,575 | 7/1928 | France | 52/64 |
| 353,083 | 5/1922 | Germany | 52/7 |

*Primary Examiner*—J. Karl Bell
*Attorney, Agent, or Firm*—Daniel Jay Tick

[57] ABSTRACT

A plurality of motors are affixed to opposite spaced parallel walls of a room. A plurality of cable-type support members each has a first end affixed to a false ceiling at a corresponding point thereof and a second end affixed to a corresponding one of the motors. The false ceiling is thus supported in parallel spaced relation with the ceiling of the room and is selectively varied in its distance from the ceiling of the room by operation of the motors.

2 Claims, 2 Drawing Figures

MOVABLE CEILING DEVICE

DESCRIPTION OF THE INVENTION

The present invention relates to a movable ceiling device. More particularly, the invention relates to a movable ceiling device for a room having a ceiling and a pair of opposite spaced substantially parallel walls.

Objects of the invention are to provide a movable ceiling device of simple structure, which is inexpensive in manufacture, used with facility and convenience, installable in new and existing structures with facility and convenience, and functions efficiently, effectively, and reliably to selectively vary a false ceiling in its distance from the ceiling of a room.

Figure 1:
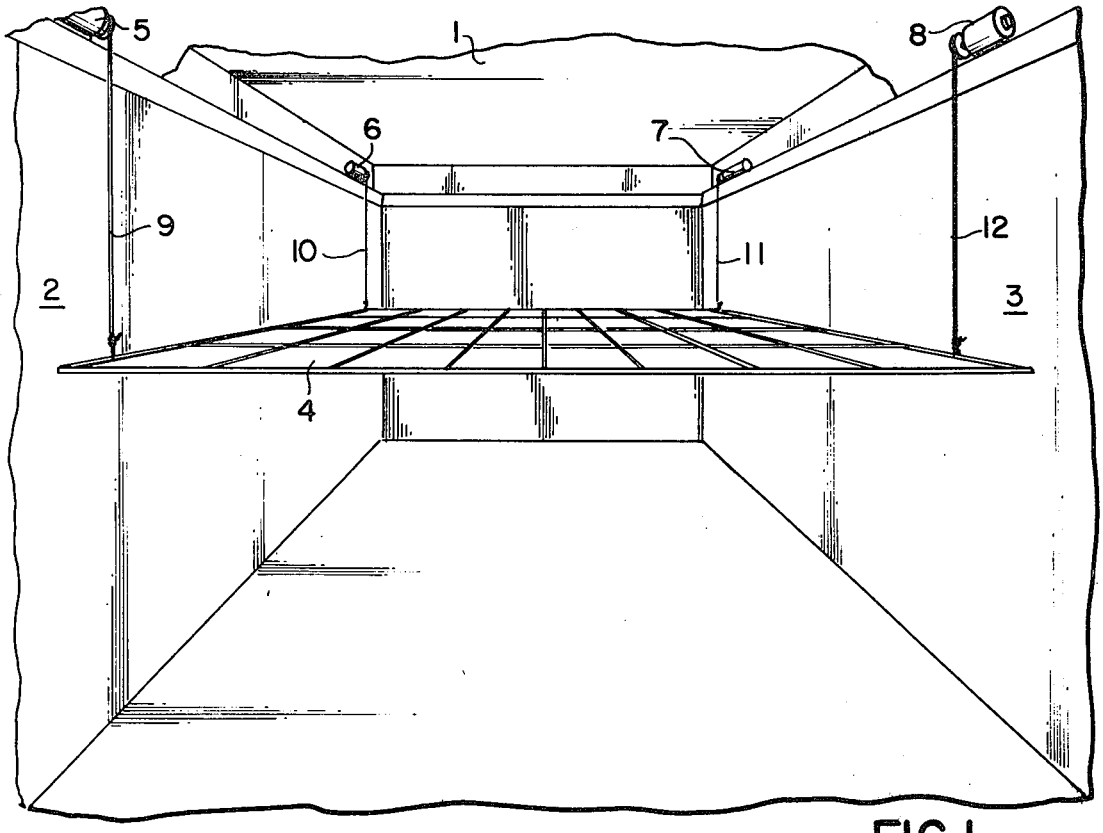
Figure 2:
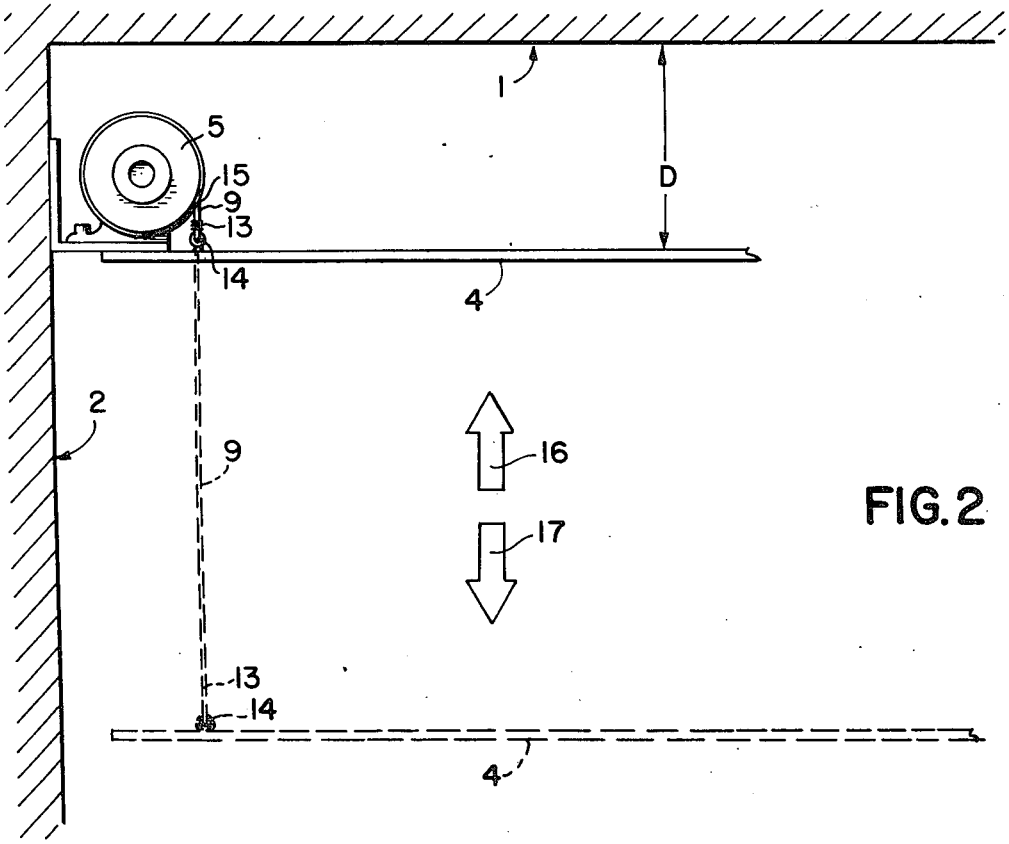

In order that the invention may be readily carried into effect, it will now be described with reference to the accompanying drawing, wherein:

FIG. 1 is a perspective view of an embodiment of the movable ceiling device of the invention; and FIG. 2 is a side view of the embodiment of FIG. 1.

The movable ceiling device of the invention is for a room having a ceiling 1 and a pair of opposite spaced substantially parallel walls 2 and 3.

The movable ceiling device of the invention comprises a false ceiling 4.

A plurality of motors 5, 6, 7 and 8 (FIG. 1) are affixed to the opposite walls 2 and 3. The motors 5 to 8 are preferably fractional horsepower electric motors having reversible directions of rotation.

A plurality of cable-type support members 9, 10, 11 and 12 (FIG. 1) are provided. Each of the cable-type support members 9 to 12 has a first end such as, for example, the first end 13 of the support member 9 (FIG. 2) affixed to the false ceiling 4 at a corresponding point 14 thereof. Each of the cable-type support members 9 to 12 has a second end, such as, for example, the end 15 of the support member 9 (FIG. 2), affixed to a corresponding one of the motors such as, for example, the motor 5 (FIG. 2). The support members 9 to 12 are affixed to the motors 5 to 8, respectively, in a manner whereby the false ceiling 4 is supported in substantially spaced relation with the ceiling 1 of the room and is selectively varied in its distance D (FIG. 2) from the ceiling of the room by operation of the motors.

Thus, when the motors 5 to 8 are rotated in one direction, they move the false ceiling 4 upward, in the direction of an arrow 16 of FIG. 2. When the motors 5 to 8 are rotated in the opposite direction, they move the false ceiling 4 downward, in the direction of an arrow 17 of FIG. 2.

While the invention has been described by means of a specific example and in a specific embodiment, I do not wish to be limited thereto, for obvious modifications will occur to those skilled in the art without departing from the spirit and scope of the invention.

I claim:

1. A movable ceiling device for a room having a ceiling and a pair of opposite spaced substantially parallel walls, said ceiling device comprising a false ceiling;

a plurality of brackets affixed to the opposite walls a close distance beneath the ceiling in mutually spaced relation;

a plurality of motors above the false ceiling and mounted on the brackets;

a plurality of pulleys, each coupled to, and rotated in opposite directions by, a corresponding one of the motors; and a plurality of cable-type support members each having a first end affixed to the false ceiling at a corresponding point thereof and a second end affixed to a corresponding one of the pulleys in a manner whereby the false ceiling is supported in substantially parallel spaced relation with the ceiling of the room and is selectively varied in its distance from the ceiling of the room by operation of the motors.

2. A movable ceiling device as claimed in claim 1, wherein the motors are fractional horsepower electric motors having reversible directions of rotation.

* * * * *